United States Patent [19]

Nafziger et al.

[11] 3,997,332

[45] Dec. 14, 1976

[54] STEELMAKING BY THE ELECTROSLAG PROCESS USING PREREDUCED IRON OR PELLETS

[75] Inventors: Ralph H. Nafziger, Albany; Clo E. Armantrout, Corvallis, both of Oreg.

[73] Assignee: The United States of America as represented by the Secretary of the Interior, Washington, D.C.

[22] Filed: Jan. 8, 1976

[21] Appl. No.: 647,309

[52] U.S. Cl. ..... 75/10 R; 75/10 C; 164/52; 164/252

[51] Int. Cl.[2] ..... C22B 4/00; B22D 27/02

[58] Field of Search ..... 75/10 R, 10 C; 164/50, 164/52, 250, 252

[56] References Cited

UNITED STATES PATENTS 3,469,968 9/1969 Snow ..... 75/10 R

*Primary Examiner*—Peter D. Rosenberg
*Attorney, Agent, or Firm*—William S. Brown; Donald R. Fraser

[57] ABSTRACT

Structurally sound steel ingots are produced by the conventional electroslag process using prereduced iron ore pellets containing as much as 2.8% oxygen pressed into a bar shape as a consumable electrode. A carbon source, such as silicon carbide or titanium carbide, is dispersed in the flux to prevent oxygen transfer from the flux to the ingot thus preventing blowhole porosity caused by the oxygen and allowing production of a structurally sound ingot. Alternatively, ferroalloys can be mixed with the iron ore pellets before pressing. This not only deoxidizes the melt, but also permits the production of specific alloy steel compositions.

7 Claims, No Drawings

STEELMAKING BY THE ELECTROSLAG PROCESS USING PREREDUCED IRON OR PELLETS

BACKGROUND OF THE INVENTION

1. Field of the Invention

This invention relates to techniques for producing carbon-containing steel shapes, directly from prereduced iron ore pellets, utilizing the electroslag melting process.

2. Description of the Prior Art

The electroslag process is a secondary melting technique developed some 30 years ago. It conventionally utilizes a consumable electrode of the metal or alloy to be melted. At the beginning of a typical melt, an arc is struck between the electrode and a base plate placed in the bottom of a water-cooled copper crucible containing a fluxing agent. The arc is immediately quenched by fusing flux. After fusion of the flux is complete, power applied to the electrodes is increased and the consumable electrode begins melting. Droplets of metal fall through the flux, collect in a pool on the base plate, and begin to solidify. As solidification proceeds, an ingot forms on the base plate and grows upwardly with a molten pool of metal on top. Molten flux in contact with the water-cooled crucible solidifies during the melt to form a thin skin between the crucible and the solidifying ingot.

In the traditional use of the electroslag process, ingots are prepared by remelting an electrode of almost identical composition to that of the required finished product. Usually some purification, such as sulfur reduction, also occurs as the molten metal droplets fall through the slag and non-metallic inclusions are removed or at least redistributed. An extension of the electroslag process was proposed by British Patent No. 1,251,660. This patent discloses use of a hollow, consumable, pipe-like electrode filled with prereduced iron powder, along with alloying constituents if desired, to form a steel ingot of the desired composition. Alternatively, the patent discloses use of a non-consumable, hollow graphite electrode through which iron powder and alloying ingredients are fed. Another reported technique, that of A. G. Thomas, published as "Direct Electroslag Melting of Steel, Refractory Metal and Ferroalloys" *Proceedings of the Third International Symposium on Electroslag and Other Special Melting Technology*, ASM and Mellon Institute, Part III, 1971, pp. 69–82, utilized a consumable electrode of mild steel. During melting, alloying powders were added to produce steel ingots of the desired composition. Alternatively, a non-consumable graphite or watercooled copper electrode was used to provide the necessary heat. Powdered sponge iron was added during the melt to produce homogenous ingots, either of stainless steel or mild steel. Additionally, partial, preliminary results of our research were presented at the AIME Annual Meeting, Dallas, Texas on Feb. 28, 1974.

SUMMARY OF THE INVENTION

We have found that carbon steel ingots meeting AISI specifications may be prepared directly from prereduced iron ore pellets by a modification of the electroslag process. Iron ore pellets are pressed into elongated compacts having sufficient structural strength and electrical conductivity to function as electrodes.

DETAILED DESCRIPTION OF THE INVENTION

Carbon steel ingots may be prepared directly from prereduced iron ore pellets by use of an electroslag remelting technique thus eliminating several steps of the conventional steel making process. Our technique is especially appropriate for small tonnage production as it requires minimal capital investment because the furnaces are inexpensive and require no refractories. Ingot products reflect the inherent advantages of electroslag remelting such as grain refinement, axial solidification, workable smooth surfaces and reduction and dispersion of inclusions.

Prereduced iron ore pellets satisfactory for use in our process must have at least 92–93% metallization and have an oxygen content below about 2.8% in order to prepare a sound ingot. Composition of the gangue constitutents of the pellet are of minimal importance providing the above criteria are met. The pellets are prepared for processing by isostatically pressing them into rods or bars to form consumable electrodes of suitable size and shape. Pressures on the order of 5000 to 6000 $kg/cm^2$ are sufficient to impart adequate mechanical strength and electrical conductivity for the pressed shape to function as an electrode. A number of separate rods or bars may be butt welded to form a longer electrode and a threaded stub is preferably welded to one end for attachment to the electrode support.

Fluxes suitable for use in our process include those conventionally employed in the electroslag remelting of similar alloy compositions. We prefer to use ternary flux compositions containing calcium fluoride, calcium oxide and alumina. A most preferred flux composition comprises about 70 wt-pct $CaF_2$, 15 wt-pct CaO and 15 wt-pct $Al_2O_3$. This flux has a liquidus temperature of about 1375° C with a melting range of about 200° C. The primary phase is $CaF_2$ which melts at 1423° C giving rise to typically smooth ingot surfaces. Flux compositions may be prepared by blending and heating the individual components and thereafter fusing the mixture preferably under an inert atmosphere.

We have found that the provision of a carbon source dispersed in the molten flux during melting substantially improves the quality of the ingot produced and allows metallurgically sound ingots to be formed directly from the prereduced pellets. If an electrode formed of such pellets is melted without providing a carbon source within the flux, then the melt typically is erratic with considerable fuming and slag swelling. Intermittent arcing through gas pockets formed in the slag also occurs. This instability appears to be chiefly due to the transfer of iron oxide from the electrode to the flux with attendent gas evolution and frothing. We also found that oxygen derived from iron oxide contamination in the slag caused internal porosity of the formed ingot.

The carbon source which is dispersed in the slag may be either silicon carbide or titanium carbide. Calcium carbide is much less satisfactory because of its relative thermodynamic instability which leads to premature oxidation. Silicon carbide is a more effective deoxidizer than is titanium carbide. Approximately 15 wt-pct SiC is required as a flux addition to eliminate blowhole porosity in ingots electroslag melted from prereduced iron ore pellets. In contrast, nearly 40 wt-ptc TiC is necessary to attain the same result. With such high levels of TiC addition to the slag the melting step must be carefully regulated to prevent premature sidewall freezing of the slag. The greater effectiveness of SiC as a deoxidizer may be explained by the following postulated equations:

$$2\ SiC + 3FeO + 3/2\ O_2 \rightarrow 2SiO_2 + Fe_3C + CO_2$$

$$TiC + 2O_2 \rightarrow TiO_2 + CO_2$$

As set out in the equation, it is believed that nearly all of the SiC reacts with FeO in the slag. Evidently some $SiO_2$ formed in the slag is further reduced to Si which reports to the ingot. In the case of TiC, there does not appear to be any further reduction of $TiO_2$ in the slag and reduction of FeO in the slag is minimal.

It is essential that the silicon carbide or titanium carbide carbon source be added to the flux rather than pressed into the consumable electrodes. Silicon carbide or titanium carbide additions to the consumable electrode cause the electrode to crack soon after initiation of melting. The precise cause of the electrode cracking is unknown. Common deoxidizers such as aluminum shavings, cast iron scrap turnings, ferromanganese and the like can be pressed into the consumable electrodes without causing cracking of the electrode during melting. These deoxidizers also can prevent ingot porosity. In addition, appropriate ferroalloys with or without the carbide flux additions can be used to prepare specific alloy steel compositions using this technique.

The following example sets out the results of a number of experimental melts which illustrate the results achieved by practice of our invention.

EXAMPLE

A series of experimental melts were performed using additions of calcium carbide, silicon carbide or titanium carbide to the flux in an attempt to decrease ingot porosity. It had been observed that the concentration of iron oxide (wustite) increased in the slag as a result of contamination from the electrode during the melt. This led to a transfer of oxygen from the slag to the ingot causing ingot porosity.

Prereduced iron ore pellets having a metallization in excess of 93% and having an oxygen content of approximately 2.5% were isostatically pressed into 5 × 5 × 25 cm bars at a nominal pressure of 5,700 kg/cm². Three bars were butt-welded in air and a threaded stub was welded to one end to form a consumable electrode. Strength and conductivity of the consumable electrodes so fabricated were sufficient for use in electroslag melting.

The flux was $70CaF_2$-$15CaO$-$15Al_2O_3$ (wt-pct) and the flux was prepared by heating and blending the individual compounds, and fusing the mixture under an inert atmosphere. Consumable electrodes were then melted by striking an arc between the electrode and a base plate placed in the bottom of a water-cooled, copper crucible containing unmelted flux. After the flux was completely fused by the arc, power was increased causing the electrode end to melt and form droplets of metal which fell through the molten flux and solidified on the base plate to form an ingot. The resulting ingots were nominally 10 cm in diameter with a height ranging from 17.5 to 20.0 cm.

Ingot sidewall turnings and, in some cases, computer-controlled direct reading spectrograph burns of the interior of one ingot half were used for chemical analysis. Cubes for metallography and gas analyses were cut from the center interior of this ingot half. The remaining ingot half was macro etched with either 2% nital or $HCl - H_2O_2$ (4:1 by volume) in order to evaluate the molten pool depths and grain orientation. Chemical analyses were performed on the used slags, along with x-ray powder diffraction studies and microscopic analyses to identify the phases present.

Results of these tests are set out on the following table.

| Melt No. | Deoxidizer | Ingot[1] | | | | | Slag[1] | |
|---|---|---|---|---|---|---|---|---|
| | | $O_2$ | C[2] | BHN[3] | Si | Ti | $SiO_2$ | $TiO_2$ |
| 28966 | 3 $CaC_2$ | 0.150 | 0.011/0.013 | <100 | | | | |
| 29050 | 10 $CaC_2$ | 0.133 | 0.014/0.460 | " | | | | |
| 29053 | 20 $CaC_2$ | 0.095 | 0.012/0.190 | " | | | | |
| 29054 | 30 $CaC_2$ | 0.093 | 0.010/0.410 | " | | | | |
| 29309 | 10 SiC | 0.039 | 0.424/0.865 | 165/321 | 0.53 | | 21.5 | |
| 29382 | 12.5 SiC | 0.038 | 0.480/0.920 | 173/246 | 0.57 | | 17.6 | |
| 29308 | 15 SiC | 0.049 | 0.749/1.330 | 223/315 | 0.98 | | 20.6 | |
| 29226 | 20 SiC | 0.037 | 0.856/1.320 | 201/345 | 0.55 | | 19.5 | |
| 29171 | 30 SiC | 0.052 | 0.741/1.150 | 300 | 0.74 | | 25.4 | |
| 29165 | 20 TiC | 0.126 | 0.013/0.042 | <100 | | <0.005 | | 2.3 |
| 29170 | 30 TiC | 0.031 | 0.352/0.485 | 148 | | <0.013 | | 10.2 |
| 29310 | 40 TiC | 0.028 | 0.456/0.714 | 172/242 | | 0.003 | | 15.7 |
| 29225 | 50 TiC | 0.018 | 0.594/0.635 | 231/226 | | 0.037 | | 15.2 |

[1]Wt% indicated for all values given
[2]First value refers to top of ingot; second to ingot bottom
[3]3,000 kg load, 10 mm steel ball; first value from ingot interior, avg. of top, center, and bottom; second value from ingot surface, avg. of top, and bottom.

As is shown by the Table, when $CaC_2$ was added to melts, increasing the $CaC_2$ concentration in the flux decreased the oxygen content of the ingot. A corresponding decrease in wormhole porosity was also noted but this was not entirely eliminated even when 30 wt-pct $CaC_2$ was added to the flux. Carbon distribution in the resulting ingots varied widely; the bottom portion of the ingot containing as much as 40 times the amount of carbon present near the ingot top. Metallographic specimens taken from the center of the ingots showed only the presence of $\alpha$-iron, with grain sizes randomly ranging from 1 to 3 on the ASTM E112-63 scale. No systematic variation of non-metallic inclusions was noted as a function of the amount of $CaC_2$ added. In all cases, the used slags contained wustite, ranging from 17 to 24 wt-pct.

Silicon carbide was very effective in reducing the oxygen content of ingots as is shown by the middle grouping of data in the Table. Approximately 15 wt-pct SiC added to the flux was required to eliminate blowhole porosity in the resulting ingots. More carbon transferred to the ingot as the amount of SiC added to the flux was increased but the distribution of carbon throughout the ingot remained relatively uniform. A Widmanstatten structure ($\alpha$-iron + perlite) characterized the microstructure of ingots melted with fluxes containing less than 15 wt-pct SiC. Greater concentration of SiC in the flux resulted in ingots containing probable martensite with pearlite. As greater amounts of SiC were added to the flux, the ingot hardness increased and up to about 1% Si transferred to the ingot. All ingots melted with fluxes having SiC additions displayed grain sizes larger than 1 on the ASTM E112-63 scale. Ingot macrostructures revealed a transition from columnar grain growth to equiaxed grains at SiC additions greater than 15 wt-pct.

Titanium carbide additions to the flux were not as effective as equivalent amounts of SiC in controlling the transfer of oxygen to the ingot. Less carbon reported to the ingot and the ingot hardness was lower than was the case with SiC. There was little transfer of titanium to the ingot and a relatively small amount of $TiO_2$ reported to the slag. Nearly 40 wt-pct TiC was necessary to minimize ingot blowhole porosity. At such levels of TiC additions, the melt required careful regulation to avoid premature sidewall freezing of the slag. Regardless of the amount of TiC added to the flux, the ingots displayed a Widmanstatten microstructure with grain sizes larger than 1.

By addition of appropriate alloying metals to the pressed electrode, it was possible to produce satisfactory plain carbon, high manganese, and high alloy machinery steel ingots in the manner described.

We claim:

1. A method for preparing carbon steel shapes from prereduced iron ore pellets which consists essentially of:

compressing prereduced iron ore pellets having a metallization of at least 92% and an oxygen content below 2.8% into an elongated bar having sufficient structural strength and electrical conductivity to serve as an electrode;

immersing one end of said bar as an electrode in a molten flux contained in a mold, said mold having a base plate upon which a solidifying ingot acting as a secondary electrode is formed;

passing an electrical current between said bar and said base plate through the molten flux to melt the bar and to form a steel shape conforming generally to the shape of said mold;

maintaining a carbon source within said molten flux, said carbon source selected from the group consisting of silicon carbide, titanium carbide and mixtures thereof dispersed in said flux, and recovering a structurally sound steel shape containing carbon in the range of 0.01 to 1.5 wt-pct.

2. The method of claim 1 wherein said flux is a ternary composition containing calcium fluoride, calcium oxide and alumina.

3. The method of claim 2 wherein said carbon source is silicon carbide.

4. The method of claim 3 wherein silicon carbide is added to the flux in an amount greater than 15% of the flux weight.

5. The method of claim 4 wherein said flux composition comprises about 70 wt-pct calcium fluoride, 15 wt-pct calcium oxide and 15 wt-pct alumina.

6. The method of claim 2 wherein said carbon source is titanium carbide.

7. The method of claim 6 wherein titanium carbide is added to the flux in an amount approximately 40% of the flux weight.

* * * * *